US007734223B2

(12) United States Patent
Fujita

(10) Patent No.: US 7,734,223 B2
(45) Date of Patent: Jun. 8, 2010

(54) IMAGE FORMING APPARATUS AND PROCESS CARTRIDGE EMPLOYING THE SAME HAVING BRUSH ROLLER CHARGER

(75) Inventor: Tetsumaru Fujita, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 715 days.

(21) Appl. No.: 11/515,858

(22) Filed: Sep. 6, 2006

(65) Prior Publication Data

US 2007/0059034 A1 Mar. 15, 2007

(30) Foreign Application Priority Data

Sep. 15, 2005 (JP) ..... 2005-268937

(51) Int. Cl.
*G03G 15/02* (2006.01)

(52) U.S. Cl. ..... 399/175

(58) Field of Classification Search ..... 399/89, 399/168–176

See application file for complete search history.

(56) References Cited

U.S. PATENT DOCUMENTS

| | | | | |
|---|---|---|---|---|
| 5,455,661 | A * | 10/1995 | Yoshida et al. | 399/175 |
| 6,272,303 | B1 * | 8/2001 | Takeda | 399/175 |
| 2003/0180646 | A1 * | 9/2003 | Asano et al. | 430/126 |
| 2004/0072093 | A1 * | 4/2004 | Itami | 430/125 |
| 2006/0088776 | A1 * | 4/2006 | Asano et al. | 430/45 |
| 2009/0028606 | A1 | 1/2009 | Fujita et al. | |
| 2009/0041491 | A1 | 2/2009 | Shono et al. | |
| 2009/0067887 | A1 | 3/2009 | Fujita et al. | |

FOREIGN PATENT DOCUMENTS

| | | |
|---|---|---|
| JP | 61-81666 | 5/1986 |
| JP | 4-96080 | 3/1992 |
| JP | 11-84798 | 3/1999 |
| JP | 3399933 | 2/2003 |

* cited by examiner

*Primary Examiner*—David M Gray
*Assistant Examiner*—Ruth N Labombard
(74) *Attorney, Agent, or Firm*—Oblon, Spivak, McClelland, Maier & Neustadt, L.L.P.

(57) ABSTRACT

An image forming apparatus and process cartridge employed in same which, when contact charging processing is implemented employing a brush roller, suppresses the generation of localized excessive discharge and suppresses a state of localized excessive discharge on a photosensitive drum surface. Charging means is configured from a brush roller in the surface of which a brush is formed, drive means for rotationally driving the brush roller, and a power source for applying a prescribed charging voltage to the brush roller, and uniformly charges the surface of the latent image carrier by bringing the brush roller into contact with the surface of the latent image carrier. The outer diameter of the latent image carrier is in the range 16 [mm] or more and 34 [mm] or less, the outer diameter of the brush roller is in the range 6 [mm] or more and 24 [mm] or less, and the outer diameter of the latent image carrier and the outer diameter of the brush roller are set so that the sum of the outer diameters thereof is 40 [mm] or less.

3 Claims, 8 Drawing Sheets

FIG. 3

| PHOTOCONDUCTOR OUTER DIAMETER [ mm ] | BRUSH ROLLER OUTER DIAMETER [ mm ] | SUM OF OUTER DIAMETERS [ mm ] | CORE DIAMETER [ mm ] | PILE LENGTH [ mm ] | EVALUATION RESULT |
|---|---|---|---|---|---|
| 30 | 10 | 40 | 4 | 3 | ○ |
| 30 | 14 | 44 | 6 | 4 | × |
| 24 | 11 | 35 | 5 | 3 | ○ |
| 24 | 14 | 38 | 6 | 4 | ○ |
| 24 | 16 | 40 | 6 | 5 | ○ |
| 24 | 20 | 44 | 8 | 6 | × |

FIG. 4

| PHOTOCONDUCTOR OUTER DIAMETER [ mm ] | BRUSH ROLLER OUTER DIAMETER [ mm ] | SUM OF OUTER DIAMETERS [ mm ] | CORE DIAMETER [ mm ] | PILE LENGTH [ mm ] | BRUSH INTRUSION AMOUNT [ mm ] | EVALUATION RESULT |
|---|---|---|---|---|---|---|
| 30 | 10 | 40 | 4 | 4 | 2 | ◎ |
| 24 | 11 | 35 | 5 | 4 | 2 | ◎ |

FIG. 5

| PHOTOCONDUCTOR OUTER DIAMETER [ mm ] | BRUSH ROLLER OUTER DIAMETER [ mm ] | SUM OF OUTER DIAMETERS [ mm ] | CORE DIAMETER [ mm ] | PILE LENGTH [ mm ] | Vpp [ V ] | EVALUATION RESULT |
|---|---|---|---|---|---|---|
| 30 | 10 | 40 | 4 | 3 | 1200 | ○ |
| 30 | 14 | 44 | 6 | 4 | 1200 | × |
| 24 | 11 | 35 | 5 | 3 | 1200 | ○ |
| 24 | 14 | 38 | 6 | 4 | 1200 | ○ |
| 24 | 16 | 40 | 6 | 5 | 1200 | ○ |
| 24 | 20 | 44 | 8 | 6 | 1200 | × |
| 24 | 11 | 35 | 5 | 3 | 1100 | ◎ |
| 24 | 11 | 35 | 5 | 3 | 800 | ◎ |

FIG. 6

| PHOTOCONDUCTOR OUTER DIAMETER [ mm ] | BRUSH ROLLER OUTER DIAMETER [ mm ] | SUM OF OUTER DIAMETERS [ mm ] | CORE DIAMETER [ mm ] | PILE LENGTH [ mm ] | SLANTED FIBER AMOUNT [ mm ] | ROTATIONAL DIRECTION | INTRUSION AMOUNT [ mm ] | EVALUATION RESULT (NORMAL HUMIDITY ENVIRONMENT) | EVALUATION RESULT (LOW HUMIDITY ENVIRONMENT) |
|---|---|---|---|---|---|---|---|---|---|
| 24 | 11 | 35 | 5 | 3 | 0 | COUNTER | 0.6 | ○ | — |
| 24 | 11 | 35 | 5 | 4 | 2 | COUNTER | 0.6 | ◎ | × |
| 24 | 11 | 35 | 5 | 4 | 2 | REVOLVING DIRECTION | 0.6 | ◎ | ○ |
| 24 | 11 | 35 | 5 | 4 | 2 | REVOLVING DIRECTION | 0.4 | ◎ | ◎ |
| 24 | 11 | 35 | 5 | 4 | 2 | REVOLVING DIRECTION | 0.2 | ◎ | ◎ |

IMAGE FORMING APPARATUS AND PROCESS CARTRIDGE EMPLOYING THE SAME HAVING BRUSH ROLLER CHARGER

BACKGROUND OF THE INVENTION

1. Field of the Invention

The present invention relates to an image forming apparatus such as an electrophotographic copier, a printer and facsimile device that uniformly charges the surface of a drum-shaped latent image carrier using charging means, develops the latent image formed on the surface of the charged latent image carrier to produce a visible image, and then finally forms this visible image on a recording material, and a process cartridge employed in same.

2. Description of the Related Art

The conventional charging means used in this type of image forming apparatus is a non-contact charging device such as a scorotron charger that charges the surface of a photosensitive drum that serves as a latent image carrier without contact therewith. However in order to generate discharge, non-contact charging devices generate the discharge products ozone and NOx which are known to create a variety of undesirable outcomes. For this reason, attention has switched in recent years to contact-type charging devices that generate a negligible amount of these discharge products.

In known contact-type charging devices the charging process is implemented by bringing of a contact charging member such as a charging roller or charging brush having a flat surface or a fixed-type or rotating-type charging brush into contact with a photosensitive drum surface. In these contact-type charging devices affixing material such as the toner affixed to the photosensitive drum surface is likely to affix to the contact charging member causing a drop in charging capacity over time. Of the contact charging members described above, from the viewpoint of the comparatively small drop in charging capacity that occurs over time, the rotating-type charging brush (brush roller) is the most useful. A known example of an apparatus that employs a roller of this type is described in Japanese Laid-Open Patent Application No. H11-84798. The image forming apparatus described in this gazette implements the charging process while a charging roller brush, serving as the brush roller, is rotationally driven in a counter direction to the surface movement direction of the photosensitive drum surface.

However, there is a drawback inherent to the implementation of a charging process based on the use of a brush roller such as this in that localized excessive discharge is likely to occur when, following contact with the photosensitive drum surface, the brush tip is separated from the photosensitive drum surface. The occurrence of this localized excessive discharge creates a problem of localized excessive discharge in a corresponding position on the photosensitive drum surface. This problem creates a condition whereby, as a result of the fact that, for example in so-called negative-positive developing, the electric potential of the areas of excessive discharge are unable to be lowered sufficiently even after exposure, the toner does not affix to these areas resulting in the generation of white spots on the image.

Technologies relating to the present invention are also disclosed in, for example, Japanese Patent No. 3,399,933, Japanese Laid-Open Patent Application No. S61-081666 and Japanese Laid-Open Patent Application No. H04-096080.

SUMMARY OF THE INVENTION

With the foregoing in view, it is an object of the present invention to provide an image forming apparatus that, in the implementation of a contact charging process employing a brush roller, suppresses the generation of localized excessive discharge and is able to suppress a condition of localized excessive discharge on the photosensitive drum surface, and a process cartridge employed in same.

In an aspect of the present invention, an image forming apparatus comprises a drum-shaped latent image carrier; a charging device for uniformly charging the surface of the latent image carrier; a latent image forming device for forming latent images on the surface of the latent image carrier charged by the charging device; and a developing device for developing the latent image on the surface of the latent image carrier into a visible image. The charging device is configured from a brush roller in the surface of which a brush is formed, a drive device for rotationally driving the brush roller, and a voltage applying device for applying a prescribed charging voltage to the brush roller, and uniformly charges the surface of the latent image carrier by bringing the brush roller into contact with the surface of the latent image carrier. The outer diameter of the latent image carrier is in the range 16 [mm] or more and 34 [mm] or less, the outer diameter of the brush roller is in the range 6 [mm] or more and 24 [mm] or less, and the outer diameter of the latent image carrier and the outer diameter of the brush roller are set so that the sum of the outer diameters thereof is 40 [mm] or less.

In another aspect of the present invention, a process cartridge is detachably attached to the main body of an image forming apparatus which comprises a drum-shaped latent image carrier; a charging device for uniformly charging the surface of the latent image carrier; a latent image forming device for forming latent images on the surface of the latent image carrier charged by the charging device; and a developing device for developing the latent image on the surface of the latent image carrier into a visible image. The charging device is configured from a brush roller in the surface of which a brush is formed, a drive device for rotationally driving the brush roller, and a voltage applying device for applying a prescribed charging voltage to the brush roller, and uniformly charges the surface of the latent image carrier by bringing the brush roller into contact with the surface of the latent image carrier. The outer diameter of the latent image carrier is in the range 24 [mm] or more and 30 [mm] or less, the outer diameter of the brush roller is in the range 10 [mm] or more and 16 [mm] or less, the outer diameter of the latent image carrier and the outer diameter of the brush roller are set so that the sum of the outer diameters thereof is 40 [mm] or less, and at least the latent image carrier and the brush roller are integrally supported.

BRIEF DESCRIPTION OF THE DRAWINGS

The above and other objects, features and advances of the present invention will become more apparent from the following detailed description based on the accompanying drawings in which:

FIG. 3 is a table showing the test results of a Test Example 1 of the present invention;

FIG. 4 is a table showing the test results of a Test Example 2 of the present invention;

FIG. 5 is a table showing the test results of a Test Example 3 of the present invention;

FIG. 6 is a table showing the test results of a Test Example 4 of the present invention;

DESCRIPTION OF THE PREFERRED EMBODIMENTS

An embodiment in which the present invention is applied to an electrophotographic laser printer (hereinafter "printer") that serves as an image forming apparatus will be hereinafter described.

Figure 1:
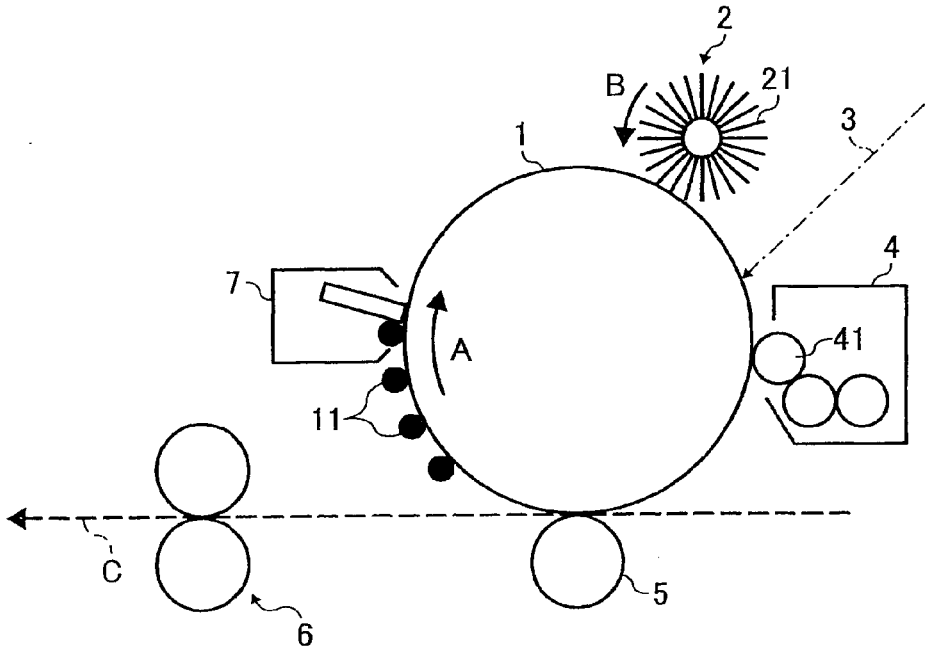
FIG. 1 is a schematic diagram of a printer that serves as an image forming apparatus pertaining to a first embodiment of the present invention.

FIG. 1 shows a schematic configuration of the printer as a whole pertaining to this embodiment.

In this printer, as shown in the drawing, a charging device 2 that serves as charging means for uniformly charging the surface of a photoconductor 1, an exposure device not shown in the drawing that serves as latent image forming means for uniformly irradiating a laser light 3 modulated in accordance with image information onto the photoconductor 1, a developing device 4 that serves as developing means for forming toner images (visible images) by affixing charging toner onto a developing roller 41 that serves as a developing agent carrier for the electrostatic latent images formed on the photoconductor 1, a transferring device 5 for transferring the toner images formed on the photoconductor 1 onto a transfer paper that serves as a recording material, and a cleaning device 7 for removing the toner remaining on the photoconductor 1 after transfer and so on are disposed in this order in the periphery of the drum-shaped photoconductor 1 that serves as a latent image carrier.

The printer further comprises, amongst other component parts, a paper supply/carry device not shown in the drawing for supplying and carrying the transfer paper from a paper supply tray or the like not shown in the drawing along the line of the arrow C shown in the drawing, and a fixing device 6 for fixing the toner images transferred by the transferring device 5 onto the transfer paper.

Some of the plurality of devices from which this printer is configured may be configured as an integrated structure (unit) detachably attached to the printer main body. In this embodiment the photoconductor 1, a brush roller 21 from which the charging device 2 is configured, the developing device 4 and the cleaning device 7 are integrally supported in a process cartridge that is detachably attached to the main body. Provided it at least supports the photoconductor 1 and brush roller 21 from which the charging device 2 is configured, the process cartridge is not restricted to this configuration.

In a printer of this configuration, the surface of the photoconductor 1 rotationally driven in the direction of the arrow A in the drawing is uniformly charged by the charging device 2. The specifics of the charging process implemented by the charging device 2 will be described later. The laser light 3 modulated in accordance with image information is scanned from the exposure device and irradiated onto the charged surface of the photoconductor 1 in the axial direction of the photoconductor. By virtue of this, an electrostatic latent image is formed on the photoconductor 1. The electrostatic latent image formed on the photoconductor 1 is formed as a toner image by affixing and developing of charging toner on the developing roller 41 in a developing region opposing the developing roller 41 of the developing device 4. Meanwhile, the transfer paper is supplied and carried by the paper supply/carry device not shown in the drawing and fed and carried by a resist roller at a prescribed timing to a transfer region in which the photoconductor 1 and transferring device 5 are opposed. The toner image formed on the photoconductor 1 is transferred onto the transfer paper by the transferring device 5 by imparting of an electric charge to the transfer paper of reverse polarity to the toner image on the photoconductor 1. Next, the transfer paper is separated from the photoconductor 1 and fed to the fixing device 6 where the toner image is fixed, following which it is discharged to the apparatus exterior. The surface of the photoconductor 1 following the transfer of the toner image by the transferring device 5 is cleaned by the cleaning device 7 to remove the residual toner on the photoconductor 1.

While the configuring of the above photoconductor 1 is based on the coating of a photosensitive inorganic or organic photoconductor to form a photoconductive layer on an aluminum cylinder or the like, it may be formed in other configurations. While the photoconductor 1 used in this embodiment is uniformly charged to a negative polarity, in consideration of the relationship with the toner charge polarity and so on, a photoconductor uniformly charged to a positive polarity may be used.

The charging process that constitutes the characterizing feature of the present invention will be hereinafter described.

Figure 2:
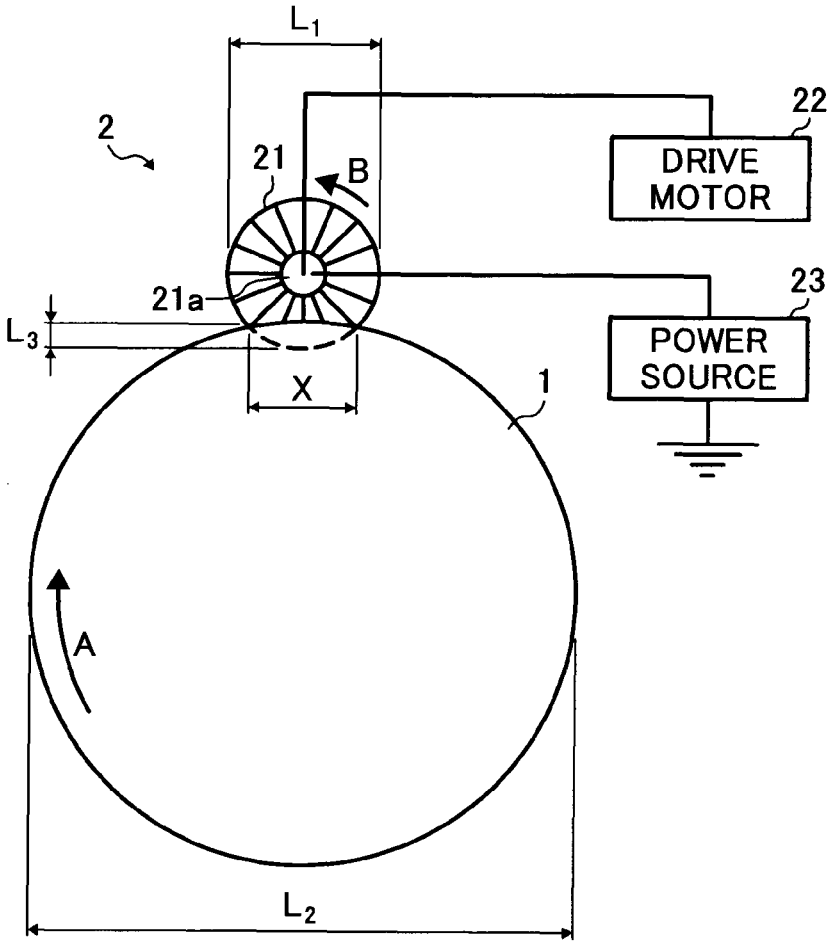
FIG. 2 is a schematic diagram of a charging device of this printer.

FIG. 2 shows a schematic configuration of the charging device 2. As shown in the drawing, the charging device 2 of this embodiment is configured from a brush roller 21 in the upper surface of which a brush is formed, a drive motor 22 that serves as drive means for rotationally driving the brush roller 21, and a power source 23 that serves as voltage applying means for applying a prescribed charge voltage to the brush roller 21. The charging device 2 uniformly charges the surface of the photoconductor by bringing the brush roller 21 into contact with the upper surface of the photoconductor 1 as shown in the drawing. The symbol $L_1$ in the drawing denotes the outer diameter of the brush roller 21, $L_2$ denotes the outer diameter of the photoconductor 1, and $L_3$ denotes the brush intrusion amount of the brush roller 21 into the photoconductor surface. The "brush intrusion amount" refers to the distance between the point where the brush tip is located in the absence of the arrangement of the photoconductor 1 arranged and the point where the photoconductor surface is located upon arrangement of the photoconductor 1 on a virtual line that connects the rotating center of the photoconductor 1 and the rotating center of the brush roller 21.

The brush roller 21 of this embodiment is produced by winding a sheet-like brush material in which brush fibers of volume resistivity approximately $10^8$ [Ω·cm] and size 2 [Denier] is provided at a density of 200 [kF] in a roll shape on a shaft 21*a*. As the brush fiber material, Nylon (registered trademark) or acrylic fibers or the like may be employed. In addition, the brush roller 21 is arranged to produce a brush intrusion depth of 0.25 [mm], and the contact charging process is implemented while the brush roller 21 is rotationally driven by a drive motor 22 in a revolving direction B with respect to the surface movement direction of the photoconductor 1. The voltage applied from the power source 23 to the brush roller 21 at this time is an alternating current voltage with a peak-to-peak voltage value $V_{pp}$ of 600 [V] or more and 1100 [V] or less, and more preferably 800 [V] or more and 1100 [V] or less.

In this embodiment the outer diameter of photoconductor 1 is in the range 16 [mm] or more and 34 [mm], and more preferably in the range 24 [mm] or more and 30 [mm] or less. Stable image formation is difficult to achieve when the outer diameter of the photoconductor 1 is less than 16 [mm]. Photoconductors that facilitate stable image formation can be produced without significant increase in cost as long as the outer diameter of the photoconductor 1 is 24 [mm] or more.

On the other hand, the outer diameter of the brush roller 21 is in the range 6 [mm] or more and 24 [mm], and more preferably in the range 10 [mm] or more and 16 [mm] or less. Because the core of the brush roller 21 must at its minimum be a diameter of the order of 4 [mm] and, in addition, for the original function of the brush to be demonstrated, the brush length must be of the order of 1 [mm], the minimum outer diameter of the brush roller 21 is of the order of 6 [mm].

In this embodiment the outer diameters are set so that the sum of these outer diameters is 40 [mm] or less. In this embodiment the outer diameter of the photoconductor 1 is 24 [mm] and the outer diameter of the brush roller 21 is 11 [mm]. When the outer diameter of the photoconductor 1 and the outer diameter of the brush roller 21 are set in this way, at least one of either the curvature of the photoconductor 1 or the brush roller 21 increases. As a result, compared to settings different thereto, localized excessive discharge in the region adjacent to a contact region X with the photoconductor surface in the surface movement direction downstream side of the brush roller (region adjacent to the right side in the drawing) is suppressed.

While in this embodiment an image-forming system comprising a cleaning device 7 is described, in cleanerless systems that do not comprise a cleaning device 7 such as this the adopting of the settings described above to suppress localized excessive discharge is useful. A cleanerless system constitutes a system in which transfer residual toner is not recovered from the photoconductor 1 using a special cleaning means such as the cleaning device 7 but is instead recovered by the developing device 4 or the like. In this kind of system, because the surface of the photoconductor 1 to which the transfer residual toner is affixed contacts the brush roller 21, the transfer residual toner is more likely to affix to the brush roller 21. When the transfer residual toner affixes to the brush roller 21 the resistance between the brush roller 21 and surface of the photoconductor 1 rises and localized excessive discharge (concentrated discharge) is more likely to occur. Accordingly, in cleanerless systems in which concentrated discharge is likely to occur, the adopting of the settings described above to suppress concentrated discharge is useful.

Next, a test conducted by the inventor of the present invention will be described (hereinafter this test is referred to as "Test Example 1").

As in the above embodiment, the brush roller 21 employed in Test Example 1 was formed by a sheet-like brush material in which brush fibers of volume resistivity approximately $10^8$ [Ω·cm] and size 2 [Denier] is provided at a density of 200 [kF] in a roll shape on a shaft 21*a*. In Test Example 1 the brush roller 21 was rotationally driven in the counter direction to the surface movement direction of the photoconductor 1 (reverse direction to the arrow B in the drawing), and a direct current voltage was applied to the brush roller 21. The process speed of the photoconductor 1 in Test Example 1 was 100 [mm/s], the direct current voltage applied to the brush roller 21 was −1.2 [kV], and the brush intrusion amount $L_3$ was 0.5 [mm].

In Test Example 1, 1×1 and 2×2 uniform halftone solid images were formed by the above printer employing a plurality of photoconductors 1 of different outer diameter and a plurality of brush roller of different outer diameter, and the generated level of white dots in these formed images were evaluated in 3 stages. A 1×1 image refers to an image in which a 1 [dot] image part and a 1 [dot] non-image part exist alternately, while a 2×2 image refers to an image in which a 2 [dot] image part and a 2 [dot] non-image part exist alternately. White spots are more prominent in a 1×1 image than a 2×2 image. The specific evaluation method of Test Example 1 was based on the inventor of the present invention comparing the images formed in the Test Example 1 with an evaluation image prepared in advance with the naked eye. The generated level of white spots in the evaluation image was equivalent to the permissible utilizable limit. In the comparative results thereof the 2×2 images in which the generated level of white spots was worse than in the evaluation image (that is to say, when the number of white dots is large) were evaluated with a cross, the 2×2 images in which the generated level of white spots was better than the evaluation image were evaluated with a single circle, while the 1×1 images in which the generated level of white spots was better than the evaluation image was evaluated with a double circle. FIG. 3 shows the test results of Test Example 1.

The results of Test Example 1 shown in FIG. 3 confirm that when the sum of the outer diameter of the photoconductor 1 and the outer diameter of brush roller 21 is 40 [mm] or less the evaluation result was a single circle or better. The reason for this is thought to be as follows. That is to say, the generation of white spots is attributable to the localized excess discharge that is generated when the brush tip, after contact with the surface of the photoconductor 1, is separated from the photoconductor surface. More specifically, localized excessive discharge (concentrated discharge) is able to occur when a state in which the brush tip and photoconductor surface are in close proximity with each other is formed after the brush tip has been separated from the photoconductor surface. Consequently, the broader the region across which the brush tip and the photoconductor surface are in contact with each other (discharge generating region) the more likely it is that a condition in which localized excessive discharge is likely to occur will be produced. When the sum of the outer diameter of the photoconductor 1 and the outer diameter of the brush roller 21 is 40 [mm] or less, the curvature of at least one of either the photoconductor 1 or the brush roller 21 increases. By virtue of this, the discharge generating region in the region of the brush tip following separation from the photoconductor surface is reduced. As a result, a condition in which it is unlikely that localized excessive discharge will occur is produced, and this is thought to be the reason for the better white spot evaluation.

While in Test Example 1 the brush roller 21 was rotationally driven in a counter direction to the surface movement direction of the photoconductor 1, an equivalent effect (or better effect) can be produced when it is driven in the revolving direction thereto.

In addition, while in Test Example 1 the process line speed of the photoconductor 1 was set at 100 [mm/s] an equivalent effect can be produced in the range 50 [mm/s] or more and 200 [mm/s] or less.

In addition, while in Test Example 1 the voltage applied to the brush roller 21 is a −1.2 [kV] direct current voltage, an equivalent effect can be produced in the range −0.7 [kV] or more and less than −1.2 [kV].

In Test Example 1 the voltage applied to the brush roller 21 was a direct current voltage which generates discharge more readily than an alternating current voltage, and as the direct current voltage value thereof a value near the upper limit value of −1.2 [kV] of the normally used range was employed. Consequently, provided the voltage applied to the crush roller 21 is within the normally used range, results equivalent to those of the Test Example 1 will be produced.

Next, another test conducted by the inventor of the present invention will be described (hereinafter this test is referred to as "Test Example 2").

For Test Example 2 the two configurations of Test Example 1 that produced the single circle evaluation result (the photoconductor outer diameter 30 [mm] and brush roller outer diameter 10 [mm] configuration and the photoconductor outer diameter 24 [mm] and brush roller diameter 11 [mm] configuration) of which the pile length of the brush roller 21 was increased to 1 [mm] and the fibers were slanted to produce a slanted fiber amount of 2 [mm] were employed. The same tests as conducted on Test Example 1 were conducted on these configurations. FIG. 4 shows the test results of the Test Example 2.

As shown in the above FIG. 4, when the fibers of the brush of the brush roller 21 were slanted, the generated level of white spots was also better than the evaluation image in the 1×1 image which was evaluated with a double circle. The reason for this is thought to be as follows.

That is to say, slanting the brush fibers of the brush roller 21 produces a state in the above discharge generating region in which the brush tip does not directly oppose the surface of the photoconductor 1 but rather the brush is inclined to the surface of the photoconductor 1 so that the body section of the brush opposes the surface of photoconductor 1. The result of this, which is to produce a condition in which discharge is unlikely to occur to further suppress the generation of localized excessive discharge, is thought to be why the generated level of white spots is better.

In the results of Test Example 2, equivalent results were able to be produced also when the brush roller 21 was rotationally driven in the revolving direction with respect to the surface movement direction of the photoconductor 1, when the process line speed of the photoconductor 1 was in the range 50 [mm/s] or more and 200 [mm/s] or less, and when the voltage applied to the brush roller 21 was −0.7 [kV] or more and less than −1.2 [kV].

Next, a further test conducted by the inventor of the present invention will be described (hereinafter this test is referred to as "Test Example 3").

In Test Example 3 evaluations equivalent to those of the above Test Example 1 were conducted on the configurations employed in the above Test Example 1 employing an alternating current voltage as the voltage applied to the brush roller 21. The alternating current voltage used was a rectangular wave alternating current voltage of DUTY ratio 50[%] with a peak-to-peak voltage value $V_{pp}$ at frequency 200 [Hz] of 1.2 [kV] superposed on a −500 [V] direct current voltage. FIG. 5 shows the test results of Test Example 3.

As shown in FIG. 5, even when an alternating current voltage with a peak-to-peak voltage value $V_{pp}$ of 1.2 [kV] was employed, an equivalent effect to Test Example 1 which was an evaluation result of a single circle or better was able to be produced when the sum of the outer diameter of the photoconductor 1 and the outer diameter of brush roller 21 was 40 [mm] or less. While the evaluation of Test Example 3 was equivalent to the above Test Example 1 based on a 3-stage evaluation, closer examination indicates a better generated level of white spots than in the above Test Example 1. The reason for this is considered to be as follows.

That is to say, a discharge field that generates discharge to raise the photoconductor 1 surface charged quantity and a neutralizing field that lowers the photoconductor 1 surface charged quantity are alternatingly formed on the above discharge generating region by applying of an alternating current voltage to the brush roller 21. By virtue of this, even if localized excessive discharge occurs when a discharge electric field is formed, a neutralizing electric field is subsequently formed to neutralize the area on the photoconductor surface on which the localized discharge has occurred. As a result, the charged quantity in the area that has been excessively charged by excessive discharge is lowered, and this is thought to be why the generated level of white spots is better.

More particularly, as shown in FIG. 5, for configurations of photoconductor outer diameter 24 [mm] and brush roller outer diameter 11 [mm], when the peak-to-peak voltage value $V_{pp}$ was lower than 1.2 [kV] and an alternating current voltage of 1.1 [kV] and 800 [V] was applied the generated level of white spots was also better than the evaluation image for the 1×1 image and it was evaluated with a double circle. Consequently, it is preferable that the peak-to-peak $V_{pp}$ of the alternating current voltage applied to the brush roller 21 be 1100 [V] or less. However, because a satisfactory charging irregularity control effect cannot be produced using an alternating current voltage with a peak-to-peak $V_{pp}$ of less than 600 [V], it is preferable that the peak-to-peak $V_{pp}$ of the alternating current voltage applied to the brush roller 21 be 600 [V] or more.

Next, a further test conducted by the inventor of the present invention will be described (hereinafter this test is referred to as "Test Example 4").

In Test Example 4, an evaluation of generated level of white spots was conducted on a photoconductor outer diameter 24 [mm] and brush roller outer diameter 11 [mm] configuration in each of a normal humidity environment (humidity of the order of 50[%]) and a low humidity environment (humidity of the order of 15[%]) while altering a part of the conditions of the above Test Example 3. The lower the humidity the more likely discharge is to be generated and, therefore, the evaluation results were more severe for the low humidity environment than the normal humidity environment. FIG. 6 shows the test results of Test Example 4.

As shown in FIG. 6, when a brush roller 21 of an intrusion amount of 0.6 [mm] was used, the generated level of white spots was better in the brushes of slanted fibers that the brushes of straight fibers. The reason for this is equivalent to that of Test Example 2. It is confirmed by this that the improvement effect using slanted fibers produced when an alternating current voltage is applied to the brush roller 21 is equivalent to that produced when a direct current voltage is applied.

In the low humidity environment test results, the generated level of white spots was evaluated with a cross even when the sum of the outer diameter of the photoconductor 1 and the outer diameter of the brush roller 21 was 40 [mm] or less. However, the normal usage environment is a normal humidity environment so, at least for usage in a normal usage environment, provided the sum of the outer diameter of the photoconductor 1 and the outer diameter of the brush roller 21 is 40 [mm] or less, the generated level of white spots will be evaluated with a single circle or better.

Next, slanted fiber brush rollers 21 of intrusion amount 0.6 [mm] when the rotating direction was the counter direction and when it was the revolving direction with respect to the surface movement direction of the photoconductor 1 were compared. As shown in the above Table 4, while in each of these cases the generated level of white spots in the normal humidity environment was evaluated with a double circle, in the evaluation results for the low humidity environment in which the evaluation conditions are more severe than in the normal humidity environment, the generated level of white spots was better in the revolving direction. The reason for this is thought to be as follows.

That is to say, the greater the electric potential difference between the brush tip and the photoconductor surface in the discharge generating region following separation, the more likely it is that the discharge generated when the brush tip of the brush roller 21 is separated from the surface of the photoconductor 1 will be generated. When the rotating direction of the brush roller 21 with respect to the surface movement direction of the photoconductor 1 is the counter direction, the surface of the photoconductor 1 within the discharge generating region is formed in a state that is equivalent to the surface prior to charging processing by the brush roller 21 and has a low surface electric potential. In contrast, when the rotating direction of the brush roller 21 with respect to the surface movement direction of the photoconductor 1 is the revolving direction, the surface of the photoconductor 1 within the discharge generating region is formed in a state equivalent to the surface following charging processing by the brush roller 21 and has a high surface electric potential. Accordingly, the electric potential difference between the brush tip and photoconductor surface in the discharge generating region is lower when the rotating direction of the brush roller 21 is the revolving direction than when it is the counter direction. The result of this is thought to be why the generated level of white spots is better when the rotating direction of the brush roller 21 is the revolving direction than when it is the counter direction.

Next, the brush intrusion amount in the configuration of a slanted fiber brush roller 21 rotationally driven to produce a revolving rotating direction with respect to the surface movement direction of the photoconductor 1 was altered and compared. As shown in Table 4, while in each case in the normal humidity environment the generated level of white spots was evaluated with a double circle, the evaluation results in the low humidity environment in which the evaluation conditions are more severe than in the normal humidity environment indicate that the smaller the brush intrusion amount the better the generated level of white spots. The reason for this is thought to be as follows.

That is to say, because the brush tip in contact with the surface of the photoconductor 1 forms a state in which it is being pressed by the photoconductor surface, a spring-back action of the brush tip occurs when it is separated from the surface of the photoconductor 1 due to the restoring force of the brush itself. The larger the restoration forces at this time the larger the spring-back amount, and the larger the spring-back amount the more the slanted brush fibers approximate the straight fiber state. When the brush fibers immediately following separation from the surface of the photoconductor 1 form a state approximating straight fibers, the improvement effect in the generated level of white spots produced by the above slanted fibers is reduced. The larger the brush intrusion amount the greater the restoring force of the brush to which a reduction in the improvement effect of the generated level of white spots produced by the slanted fibers is attributable. Consequently, it is thought that the smaller the brush intrusion amount the better the generated level of white spots.

While the above description cites the example of an image forming apparatus for forming monochrome images, the present invention can also have application in image forming apparatus for forming images of a plurality of colors.

Figure 7:
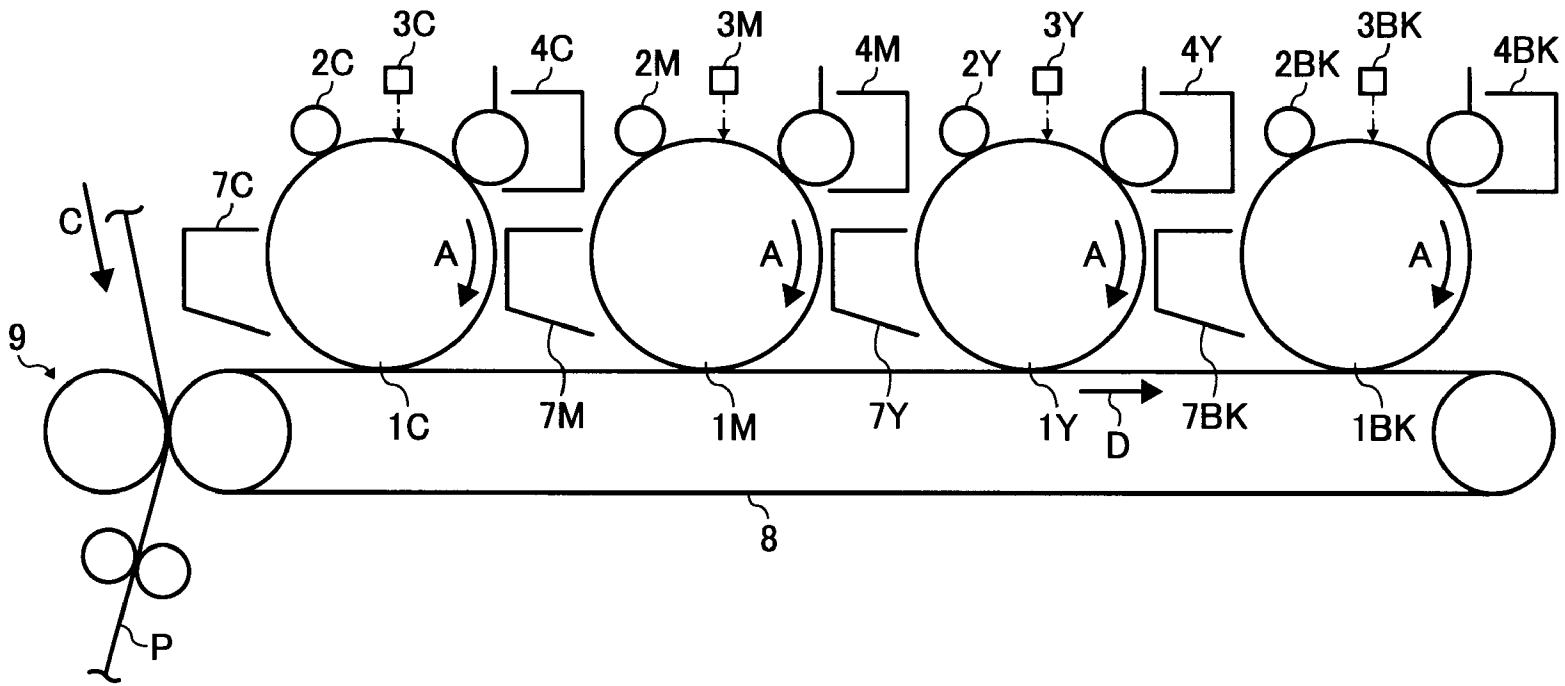
FIG. 7 is a diagram showing the configuration of the main part of a tandem-type image forming apparatus in which an intermediate transfer system is adopted.

FIG. 7 shows a configuration of a tandem-type image forming apparatus in which a so-called intermediate transfer system is adopted. As shown in the drawing, in this image forming apparatus four photoconductors 1C, 1M, 1Y, 1Bk of each of the colors of cyan (C), magenta (M), yellow (Y) and Black (Bk) are arranged along a flat part of an intermediate transfer belt 8 that serves as an intermediate transfer body. The devices or members arranged surrounding the photoconductors 1C, 1M, 1Y and 1Bk are equivalent to those in the above embodiment. In this image forming apparatus, toner images of the colors respectively formed on the four photoconductor bodes 1C, 1M, 1Y and 1Bk are primarily transferred in sequence onto the intermediate transfer belt 8 in such as way as to overlap. The color toner images formed on the intermediate transfer belt 8 by transfer in such a way as to overlap are secondarily transferred on to a transfer paper P by a secondary transferring device 9. After this, the transfer paper P carrying these color toner images is subject to a fixing processing by a fixing device not shown in the drawing before being discharged to the apparatus exterior. Similarly to the embodiment described above, localized excessive discharge can be suppressed in this image forming apparatus by adopting a configuration in which the sum of the outer diameter of the photoconductors 1C, 1M, 1Y and 1Bk and the outer diameter of the brush rollers of the charging devices 2C, 2M, 2Y and 2Bk for uniformly charging the surface thereof is 40 [mm] or less. The result of this is to produce toner images of each color in which there are few voids, and to facilitate the forming of high quality color images of good color reproduction.

Figure 8:
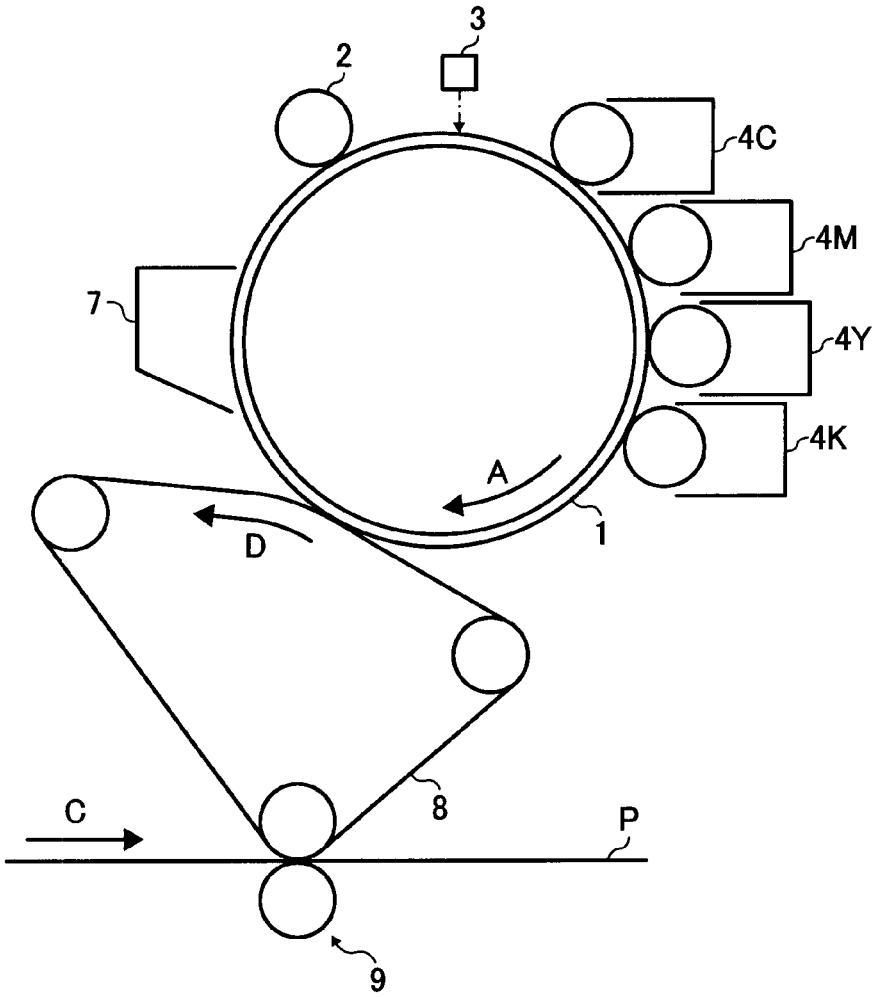
FIG. 8 is a diagram showing the configuration of the main part of a one drum-type image forming apparatus in which an intermediate transfer system is adopted.

FIG. 8 shows a configuration of the main part of a one drum-type image forming apparatus in which a so-called intermediate transfer system is adopted. As shown in the drawing, this image forming apparatus comprises a single photoconductor 1 and an intermediate transfer belt 8 that serves as an intermediate transfer body, and four developing devices 4C, 4M, 41Y and 41Bk of each of the colors of cyan (C), magenta (M), yellow (Y) and Black (Bk) arranged in the photoconductor 1. In this image forming apparatus, electrostatic latent images of each color are formed in sequence on the photoconductor 1, and these electrostatic latent images of each color are developed in sequence by each of the developing devices 4C, 4M, 41Y and 41Bk of correspondent color. The toner images of the photoconductor 1 are primarily transferred in sequence in such as way as to overlap on the intermediate transfer belt 8. The color toner images formed on the intermediate transfer belt 8 by transfer in such a way as to overlap are secondarily transferred on to a transfer paper P by a secondary transferring device 9. After this, the transfer paper P carrying these color toner images is subject to a fixing processing by a fixing device not shown in the drawing before being discharged to the apparatus exterior. Similarly to the embodiment described above, localized excessive discharge can be suppressed in this image forming apparatus by adopting a configuration in which the sum of the outer diameter of the photoconductor 1 and the outer diameter of the brush roller of the charging device 2 for uniformly charging the surface thereof is 40 [mm] or less. The result of this is to produce toner images of each color in which there are few voids, and to facilitate the forming of high quality color images of good color reproduction.

The image forming apparatus of the above embodiment comprises a photoconductor 1 which constitutes a drum-shaped latent image carrier, a charging device 2 that serves as charging means for uniformly charging the surface of the photoconductor 1, an exposure device that serves as latent image forming means for forming latent images on the surface of the photoconductor 1 charged by the charging device 2, and developing means 4 for developing the latent images on the surface of the photoconductor 1 as a visible image, the visible images on the surface of the photoconductor 1 being formed on a transfer paper that serves as a recording medium. The charging device 2 is configured from a brush roller 21 in the surface of which a brush is formed, drive motor 22 that serves as drive means for rotationally driving the brush roller 21, and power source 23 that serves as voltage applying means for applying a prescribed charging voltage to the brush roller 21, the surface of the photoconductor 1 being uniformly charged by the bringing of the brush roller 21 into contact with the photoconductor 1. The outer diameter of the photoconductor 1 is set in the range 24 [mm] or more and 30 [mm] or less, the outer diameter of the brush roller 21 is set in the range 10 [mm] or more and 16 [mm] or less, and the sum of the outer diameters of the photoconductor 1 and the brush roller 21 is set to be 40 [mm] or less. By virtue of this, as is described in Test Example 1 above, compared to settings different thereto, localized excessive discharge is suppressed in the contact region X with the photoconductor surface in the region adjacent to the surface movement direction downstream side of the brush roller. As a result, the generated level of white spots in the formed images can be suppressed and, accordingly, the image quality is improved.

In addition, as is described in the above Test Example 2, when a direct current voltage, or more particularly a direct current voltage in the range 700 [V] or more and 1200 [V] or less is applied to the brush roller 21 by a power source 23, the generated level of white spots in the formed images can be further suppressed by employing a brush roller 21 comprising a slanted fiber brush.

In addition, as is described in the above Test Example 3, if an alternating current voltage with a peak-to-peak value $V_{pp}$ of 600 [V] or more to 1100 [V] or less is applied to the brush roller 21 by the power source 23, the generated level of white spots in the formed images can be better suppressed than when a direct current voltage is applied.

More particularly, as described in the above Test Example 4, if a brush roller 21 comprising a slanted fiber brush is employed, an improvement effect in the generated level of white spots equivalent to when a direct current voltage is applied can be produced by the slanted fibers. In this case, if a brush roller 21 of a brush intrusion amount with respect to the surface of the photoconductor 1 of 0.4 [mm] or less is used, a further improvement in the generated level of white spots as described in the above Test Example 4 can be achieved.

In addition, as described in the above Test Example 4, if the brush roller 21 is rotationally driven by the drive motor 22 in the revolving direction with respect to the surface movement direction of the photoconductor 1, compared to when it is driven in the counter direction, the generated level of white spots can be further improved.

As is described above, in such a way that the sum of the outer diameter of the drum-shaped latent image carrier and the brush roller is 40 [mm] or less in the present invention, the former is set in the range from 24 [mm] or more and 30 [mm] or less and the latter is set in the range from 10 [mm] or more and 16 [mm] or less. When the outer diameter of the latent image carrier and the outer diameter of the brush roller are set in this way, at least one of the curvature of either the latent image carrier or the brush roller increases. As a result, compared to when the outer diameter of the latent image carrier and the outer diameter of the brush roller are set differently to that described above in a normal usage environment, localized excessive discharge is suppressed in a contact region X with the photoconductor surface in the region adjacent to the surface movement direction downstream side (region where the brush tip of the brush roller separates from the latent image carrier surface) of the brush roller. The reason for this, which is described in detail below, is thought to be because an increase in the curvature of at least one of the latent image carrier and brush roller results in a reduction, in the above region, of the region (discharge generating region) where the distance between the latent image carrier surface and the brush roller brush tip is less than the distance in which discharge can be generated.

While localized excessive discharge is thought to be affected by, apart from the distance between the latent image carrier surface and the brush tip of the brush roller, the electrical potential difference therebetween, provided this electric potential difference is at least in the normal range, an effect that suppresses this localized excessive discharge can be satisfactorily produced by the above setting.

Various modifications will become possible for those skilled in the art after receiving the teachings of the present disclosure without departing from the scope thereof. For example, while the above embodiment cites the example of a printer, the present invention can have application in other image forming apparatuses such as photocopiers and FAX machines.

What is claimed is:

1. An image forming apparatus, comprising:

a drum-shaped latent image carrier;

charging means for uniformly charging the surface of said latent image carrier;

latent image forming means for forming latent images on the surface of said latent image carrier charged by said charging means; and developing means for developing the latent image on the surface of said latent image carrier into a visible image, wherein said charging means is configured from a brush roller in the surface of which a brush is formed, drive means for rotationally driving said brush roller, and voltage applying means for applying a prescribed charging voltage to said brush roller, and uniformly charges the surface of said latent image carrier by bringing said brush roller into contact with the surface of said latent image carrier, the outer diameter of said latent image carrier is in the range 16 mm or more and 34 mm or less, the outer diameter of said brush roller is in the range 6 mm or more and 24 mm or less, and the outer diameter of said latent image carrier and the outer diameter of said brush roller are set so that the sum of the outer diameters thereof is 40 mm or less, wherein said voltage applying means applies an alternating current voltage with a peak-to-peak voltage value of 600V or more and 1100V or less to said brush roller, a slanted fiber brush is employed as said brush roller and the brush intrusion amount of said brush roller with respect to the surface of said latent image carrier is 0.4 mm or less wherein said drive means rotationally drives said brush roller in the revolving direction with respect to the surface movement direction of said latent image carrier.

2. The image forming apparatus as claimed in claim 1, wherein the outer diameter of said latent image carrier is in the range 24 mm or more and 30 mm or less, and the outer diameter of said brush roller is in the range 10 mm or more and 16 mm or less.

3. A process cartridge detachably attached to the main body of an image forming apparatus, comprising:

a drum-shaped latent image carrier;

charging means for uniformly charging the surface of said latent image carrier;

latent image forming means for forming latent images on the surface of said latent image carrier charged by said charging means; and developing means for developing the latent image on the surface of said latent image carrier into a visible image, wherein said charging means is configured from a brush roller in the surface of which a brush is formed, drive means for rotationally driving said brush roller, and voltage applying means for applying a prescribed charging voltage to said brush roller, and uniformly charges the surface of said latent image carrier by bringing said brush roller into contact with the surface of said latent image carrier, the outer diameter of said latent image carrier is in the range 24 mm or more and 30 mm or less, the outer diameter of said brush roller is in the range 10 mm or more and 16 mm or less, the outer diameter of said latent image carrier and the outer diameter of said brush roller are set so that the sum of the outer diameters thereof is 40 mm or less, and at least said latent image carrier and said brush roller are integrally supported, wherein said voltage applying means applies an alternating current voltage with a peak-to-peak voltage value of 600V or more and 1100V or less to said brush roller, a slanted fiber brush is employed as said brush roller and the brush intrusion amount of said brush roller with respect to the surface of said latent image carrier is 0.4 mm or less wherein said drive means rotationally drives said brush roller in the revolving direction with respect to the surface movement direction of said latent image carrier.

* * * * *